United States Patent [19]

Merchant, Jr. et al.

[11] 3,989,460

[45] Nov. 2, 1976

[54] WATER SOLUBLE WATERFLOOD CORROSION INHIBITOR

[75] Inventors: Philip Merchant, Jr.; Cosmas O. Ohaji; F. Luther Powell, all of Houston, Tex.

[73] Assignee: Exxon Research and Engineering Company, Linden, N.J.

[22] Filed: Sept. 10, 1975

[21] Appl. No.: 611,993

[52] U.S. Cl. ..... 21/2.7 R; 166/244 C; 252/8.55 E

[51] Int. Cl.[2] ..... C23F 9/00

[58] Field of Search ..... 166/244 C; 21/2.7 R; 252/8.55 E; 210/58, 59

[56] References Cited

UNITED STATES PATENTS

| | | | |
|---|---|---|---|
| 2,640,029 | 5/1953 | Blair et al. | 166/244 C |
| 2,889,193 | 6/1959 | Denman et al. | 21/2.7 R |
| 3,033,784 | 5/1962 | Jones | 166/244 C |
| 3,066,097 | 11/1962 | Jones | 252/8.55 E |

*Primary Examiner*—Thomas G. Wyse
*Attorney, Agent, or Firm*—David A. Roth

[57] ABSTRACT

Hydrochloric acid derivatives of cyclic nitrogen compounds in combination with polyalkoxylated fatty acids are water soluble, waterflood corrosion inhibitors, which because of their solubility avoid the potential clogging problems encountered with waterflood corrosion inhibitors of the art which are dispersions.

13 Claims, No Drawings

WATER SOLUBLE WATERFLOOD CORROSION INHIBITOR

CROSS REFERENCE TO RELATED APPLICATIONS

This application is an independent application, although it contains general waterflood corrosion matter similar to that disclosed in U.S. Ser. No. 575,506, commonly assigned May 8, 1975.

BACKGROUND OF THE INVENTION

Waterflooding is commonly used in the secondary recovery of oil. The water used for waterflooding is usually obtained from source wells or bodies of water such as seas which may contain corrodents such as hydrogen sulfide, carbon dioxide, oxygen and salts of the alkali and alkaline metals. The presence of such corrodents in an aqueous solution at temperatures of 100°–190° F often results in rapid deterioration of steel pipelines. A corrosion inhibitor is needed to reduce the corrosion rate to a minimum in such systems. Futhermore, when there is apparent formation plugging as a result of using dispersible inhibitors, a water soluble inhibitor is most desirable as a corrosion inhibitor in waterflood systems.

It is known in the prior art that heterocyclic nitrogen compound derivatives such as quaternary derivatives of polyalkylpyridines are important compounds when quaternized of corrosion inhibiting compositions. See for instance, U.S. Pat. Nos. 3,066,097 and 3,033,784.

It is also known from the art and is disclosed in the above U.S. Pat. No. 3,033,784 that the quaternized polyalkylpyridines should be used in combination with ethoxylated alcohol derivatives of fatty acids.

Nevertheless, it has not been generally realized how to use heterocyclic nitrogen derivatives other than quaternary derivatives in combination with suitable surfactants, such as sorbital monooleate oxyethylene condensation products to produce soluble corrosion inhibitors as opposed to the dispersions of the art.

SUMMARY OF THE INVENTION

Novel water soluble corrosion inhibitor compositions comprising hydrochloride derivatives of heterocyclic nitrogen compounds, especially polyalkylpyridine or piperazine hydrochloride are excellent soluble corrosion inhibitors, and polyalkoxylated component may also be incorporated to improve the effectiveness and water solubility of the overall inhibitor composition.

DESCRIPTION OF THE PREFERRED EMBODIMENT

Thus, the most effective commerical waterflood corrosion inhibitors are dispersible compositions or only very slightly soluble compositions in the brine used for waterflooding. However, there is a high probability of formation damage as the solubility of the inhibitor decreases. Therefore, a water soluble corrosion inhibitor that is not only an effective corrosion inhibitor, but also would minimize the possibility of formation damage to the delicate oil bearing structure and equipment used therein, would be most desirable for use in a waterflood system and such a corrosion composition has been found and forms the substance of this invention.

Thus, it has been found and forms the key aspect of this invention that a hydrochloride of a heterocyclic nitrogen, particularly a hydrochloride polyalkylpyridine or a hydrochloride piperazine is an excellent corrosion inhibitor in brine at relatively low concentrations.

In addition, the effectiveness of the hydrochloride heterocyclic nitrogen derivative can be substantially improved by utilizing a polyalkoxylated component in the composition.

Preferred polyalkoxylated compounds are formed from ethylene oxide and are specifically polyethoxylated components of long chain alcohols and long chain acids. The polyethoxylated derivative of sorbitan monooleate is especially preferred.

In addition, the preferred composition of the invention also contains a small amount, e.g., about 1 to 15, preferably 2 to 12, and most preferably 3 to 7, wt. % of water. It is theorized that the water prehydrates the polyethoxylated component, i.e. acting as a surface active agent, and thus aids in solubilizing the hydrochloride nitrogen heterocyclic derivative.

Generally, the quantity of heterocyclic nitrogen hydrochloride compound in the composition of the invention will be from 45 to 90, preferably 58 to 85, and most preferably 73 to 85, wt. %. The percentage of polyalkoxylated component will be generally from about 2 to 40, preferably 2 to 30, and most preferably 2 to 20 wt. %.

Polyalkylpyridines are preferred heterocyclic nitrogen compounds. Mixed polyalkylpyridines are especially preferred.

The mixed polyalkyl pyridines of this invention are preferably obtained by reacting ammonia and acetaldehyde, extracting the reaction product with acid and distilling from the extract the low-boiling alkyl pyridines. The residue boiling between about 200 and about 350° C is the desired material. One other suitable mixture of polyalkyl pyridines exists. It can be obtained by the vapor phase reaction of acetylene and ammonia to produce nitriles and alkyl pyridines. After the nitriles have been removed and the low-boiling alkyl pyridines have been distilled off, the residue boiling above about 200° C is a mixture of polyalkyl pyridines suitable for the invention. A commercial product representative of the ammonia-aldehyde reaction can be obtained under the trademark Alkyl Pyridines HB. A material representative of the ammonia-acetylene reaction is available under the trademark PAP. The term "high-boiling" when used hereinafter should be interpreted to mean boiling above a temperature of about 200° C.

The reactions of ammonia with acetylene and with acetaldehyde can be carried out under a wide variety of conditions. As far as can be determined, at least some high-boiling mixed polyalkyl pyridines suitable for the inventive purposes are always produced. It will generally be advisable to concentrate these materials by acid extraction, distilling off the low-boiling compounds or both, as previously noted. The acid-insoluble and low-boiling materials do not seem to have any objectionable effects, however, but simply act as diluents. Therefore, it is possible to use the entire reaction products.

The surface active agent should be water soluble and ethoxylated. That is, it should be a reaction product of ethylene oxide with some other material and thus contain a polyoxylene radical. The agent should also contain a hydrocarbon radical having at least about 12 carbon atoms, at least about 8 of which are in an aliphatic portion. These limitations exclude agents known to be inoperable. As far as known, all surface active agents meeting these requirements are operative to disperse the hydrochloride to the desired degree in at least some water or brine.

Since so many injection waters are brines, the surface active agent should preferably be nonionic in nature. This avoids the possibility of undesirable reactions between salts in the brines and ionic surface active agents. An even more highly preferred class of agents is the ester-free ether type of nonionic. This smaller class is preferred since its members are not subject to the hydrolysis which can cause decomposition of the ester type nonionics. This smaller class is made up of ethoxylated mercaptans, alcohols and alkyl phenols.

The suitability of a given surface active agent can be determined by a test specified in U.S. Pat. No. 3,033,784, column 4, lines 60–75, and column 5, lines 1–24.

Ethoxylated surface active agents are ordinarily produced by reacting the alcohol, acid, mercaptan or the like with ethylene oxide. Under these circumstances, not all molecules receive the same number of oxyethylene groups. That is, the polyoxyethylene radicals have various lengths, the average length being the number of ethylene oxide molecules per molecule of alcohol, acid or the like, in the original mixture. This distribution of lengths of polyoxyethylene radicals seems to be important to the dispersing action. In some cases, the natural distribution is not sufficiently wide. In these cases it may be advisble to blend two reaction products to obtain a wider distribution of polyoxyethylene radicals. For example, a very effective dispersing agent can be prepared by mixing two surface active agents. One may be the reaction product of one mole of nonyl phenol with 10 moles of ethylene oxide while the other is the reaction product of one mole of nonyl phenol with 20 moles ethylene oxide. If these two agents are mixed in equal proportions, the average length of the polyoxyethylene radicals will be 15 ethylene oxide groups. The lengths of the polyoxyethylene radicals are, however, distributed over a much wider range than when one mole of nonyl phenol is reacted with 15 moles of ethylene oxide. Due to the wider distribution of polyoxyethylene radical lengths, the mixture of agents has properties somewhat different from those of the unmixed reaction products.

A particularly desirable mixture of agents contains about two parts of the reaction product of one mole of nonyl phenol with 10 moles of ethylene oxide and one part of the reaction product of one mole of tridecyl alcohol with 40 moles of ethylene oxide. This mixture of agents has been effective in all types of brines tested to date containing less than about 200,000 parts per million of salt. Few, if any, other agents are so universally effective.

In general, the average polyoxyethylene radical should have a length of between about 8 and about 30 ethylene oxide units. Ordinarily, higher ethylene oxide contents should be used for agents having large hydrophobic radicals and for agents to be used in brines having high salt contents. Preferably, the average polyoxyethylene radicals should have lengths averaging between about 10 and about 20 ethylene oxide units.

A small amount of water is preferably added to the composition before mixing into the main body of water. About 10 to 20 percent by weight of the entire composition is generally desirable. No water at all is necessary for satisfactory operation but improved results are noted when the small amount of water is premixed.

The corrosion inhibiting composition may be introduced into the water system in any of several ways. Preferably, it should be injected at as early a point in the system as possible. For example, if flooding water is being obtained from a well, the treating composition may be introduced into the annular space between the tubing and casing of the well. The metal surfaces of this well, of the water-handling equipment on the surface of the earth, and in the injection wells are thus protected. A convenient point of addition is the intake of the injection pumps. Addition of the treating composition may be continuous. Since the corrosion inhibitor compound is such a strong film former, however, it will frequently be found desirable to add it intermittently.

A particularly preferred alkoxylated compound is a polyoxyethylene anhydrosorbitol monooleate containing approximately 20-25 oxyethylene groups per molecule. This emulsifier is available under the trademark "Tween 80."

Although the amount of inhibitor combination employed in corrosive well fluids is dependent on intensity of corrosive conditions and degree of protection desired, normally between about 10 and 30,000 ppm of inhibitor combination based on the corrosive well fluid mixture is utilized.

The piperazines usable in the invention as well as substituted piperazines can be generally described as follows:

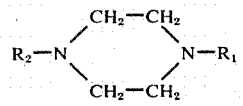

Where $R_1$ is hydrogen or amino alkyl and $R_2$ is chosen from the group consisting of hydrogen, alkyl, amino alkyl or hydroxyalkyl in which the alkyl radical is of not more than four carbon atoms.

Typical examples of these compounds are, for instance:

N-methyl piperazine

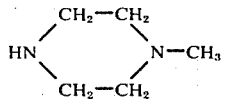

N-hydroxyethyl piperazine

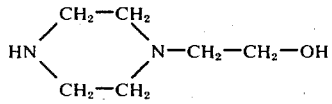

N-(2-aminoethyl) piperazine

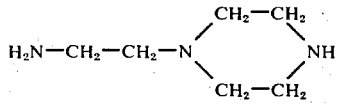

N-(3-aminopropyl) piperazine

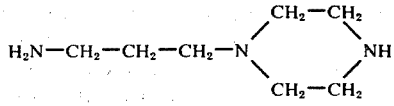

1(methyl)4(3-aminopropyl) piperazine

-continued

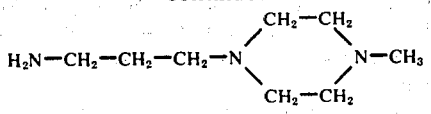

1,4-piperazine bis propylamine

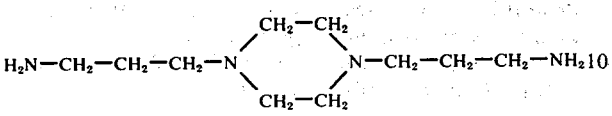

1(β-hydroxyethyl)4(3-aminopropyl) piperazine

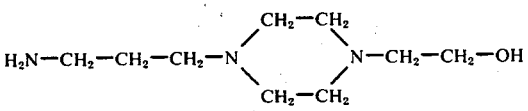

The ethyl propyl and butyl homologues of the above listed compounds may be used. Mixtures of two or more of the above may also be employed in forming the amino amide of the polybasic acids of the invention.

One may use the unpurified commercial products containing mixtures of one or more than one of the above piperazine and the alkyl, aminoalkyl, and hydroalkyl substituted piperazines, or purify them to separate some or all of the several components into any desired degree of purity and employ such fractions to produce the amino amides of the invention. The method of forming the piperazine or substituted piperazine is not a part of the invention of this application.

Also, alkyl piperazines can be used, such as the 2-alkylpiperazine which is preferred.

The 2-alkylpiperazine component of the inhibitor combination may be represented by the generic formula:

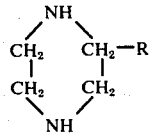

where R is a saturated aliphatic radical (alkyl) of from 1 to 18 carbons. Examples of the alkylpiperazines contemplated herein are 2-methylpiperazine, 2-ethylpiperazine, 2-isopropylpiperazine, and 2-dodecylpiperazine.

The invention is illustrated in additional detail by the following examples:

EXAMPLE I

A commercially suitable waterflood corrosion inhibitor composition was prepared utilizing the general procedures described above; the components and resulting physical properties are given below:

| Components | Wt. % |
|---|---|
| polyalkylpyridine | 57 |
| (22 Baume) hydrochloric acid | 31 |
| polyethoxylated sorbitan monooleate | 7 |
| water | 5 |

| Typical Physical Properties | |
|---|---|
| Specific gravity, 60°F/60°F | 1.1517 |
| Flash point, Tag closed cup | above 169° F |
| Pour Point | −20° F |
| Viscosities | |
| 100° F | 151.30 cs |
| 40° F | 1288.44 cs |
| 300 cs | 80° F |

-continued

| Components | Wt. % |
|---|---|
| Soluble in | Fresh water<br>Brine<br>Sea water<br>Isopropyl alcohol |
| Insoluble in | Hydrocarbons |

EXAMPLE II

The corrosion inhibitor composition of Example I was tested in comparison with commercially available water corrosion inhibitors. The results are summarized in Table II.

TABLE II

| Inhibitors | Water Solubility | Inhibitor Concentrations, ppm | | | | |
|---|---|---|---|---|---|---|
| | | .05 | 2 | 5 | 10 | 20 |
| **A(1) | dispersible | 39 | 10 | 87 | 82 | 79* |
| **B | soluble | 0 | 0 | 46 | 39 | 88 |
| Example I | soluble | 47 | 34 | 88 | 87 | 85 |

(1) 17.3 mg average blank weight loss
*Results given in percent protection
**A and B are commercially available waterflood inhibitors The experimental conditions for Example II are given below:

| Experimental Conditions | |
|---|---|
| Temperature | 180° F |
| Matrix | 6% sodium chloride |
| Hydrogen sulfide | 3 ppm |
| Carbon dioxide | saturated |
| Sulfate | 250 ppm |
| 1020 mild steel coupons, 24 hour wheel test, rotation rate 26 rpm | |

Approximately 100 milliliters of brine and a specific amount of the inhibitor were poured into a series of four-ounce glass bottles. The No. 1020 coupons were separately weighed and one coupon was submerged in each bottle of solution. Each bottle was sealed with a plastic top, placed on a corrosion wheel test apparatus and rotated twenty-four hours at a temperature of 180° F.

EXAMPLE III

The corrosion inhibitor composition of Example I was tested in the wheel test apparatus in comparison with commercially available waterflood corrosion inhibitors. The results are summarized below in Table III.

TABLE III

| Inhibitors | Water Solubility | Inhibitor Concentrations, ppm | | | | |
|---|---|---|---|---|---|---|
| | | .05 | 2 | 5 | 10 | 20 |
| **A(1) | dispersible | 27 | 70 | 76 | 94 | 91* |
| **B | soluble | 28 | 18 | 31 | 35 | 57 |
| Example I | soluble | 32 | 57 | 75 | 92 | 95 |

(1)53.8 mg average blank weight loss
*Results given in percent protection
**A and B are commercially available waterflood inhibitors The experimental conditions for Example III are given below:

| Experimental Conditions | |
|---|---|
| Temperature | 180° |
| Matrix | synthetic sea water |
| Carbon dioxide | saturated |
| 1020 mild steel coupons, 24 hour wheel test, rotation rate 26 rpm | |

EXAMPLE IV

The corrosion inhibitor of Example I was tested in the wheel test apparatus in comparison with commercially available waterflood corrosion inhibitors. The results are summarized below in Table IV.

TABLE IV

| Inhibitors | Water Solubility | Inhibitor Concentrations, ppm | | | | |
|---|---|---|---|---|---|---|
| | | .05 | 2 | 5 | 10 | 20 |
| **A(1) | dispersible | 15 | 60 | 77 | 74 | 90* |
| **B | soluble | 36 | 41 | 32 | 63 | 74 |
| Example I | soluble | 28 | 32 | 71 | 82 | 80 |

(1)17.0 mg average blank weight loss
*Results given in percent protection
**A and B are commercially available waterflood inhibitors The experimental conditions for Example IV are given below:

| Experimental Conditions | |
|---|---|
| Temperature | 180° F |
| Matrix | 3% sodium |
| Hydrogen sulfide | 3 ppm |
| Carbon dioxide | saturated |
| 1020 mild steel coupons, 24 hour wheel test, rotation rate 26 rpm | |

The alkyl pyridines of the examples are commercially available mixed alkyl pyridines obtained from the Reilly Tar and Chemical Corporation in Houston, Texas, which were made by the ammonia and aldehyde reaction, extraction and recovery process described above.

In general, suitable alkyl pyridines for this invention will fall within a boiling range of about 200° C to about 350° C.

What is claimed is:

1. A water-soluble corrosion inhibiting composition, particularly useful in waterflooding environments in which the water is a brine, which comprises from 45 to 90 wt. % of a heterocyclic nitrogen hydrochloride selected from the group consisting of alkyl piperazine hydrochlorides and alkyl pyridine hydrochlorides, from 2 to 40 wt. % of a polyethoxylated derivative from long chain alcohols and long chain acids wherein said derivative has both hydrocarbon portions and polyethoxylated portions, said hydrocarbon portion being at least 12 carbon atoms and said polyethoxylated portions having an average length of about 8 to 30 ethylene oxide units, and the balance water.

2. A composition according to claim 1 wherein said heterocyclic nitrogen hydrochloride is an alkylpiperazine.

3. The composition of claim 1 wherein said heterocyclic nitrogen compound is a polyalkylpyridine.

4. The composition of claim 3 wherein said polyalkylpyridine is a mixture of various polyalkylpyridines obtained by the vapor phase reaction of acetylene and ammonia wherein said mixture is that residue boiling above about 200° C.

5. A composition according to claim 1 wherein said polyethoxylated component is a polyoxyethylene anhydrosorbital monooleate containing approximately 20–25 oxyethylene groups per molecule.

6. A composition according to claim 2 wherein said polyalkyl piperazine has the formula

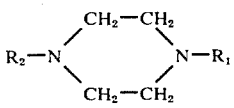

where $R_1$ is hydrogen or amino alkyl and $R_2$ is chosen from the group consisting of hydrogen, alkyl, amino alkyl or hydroxyalkyl in which the alkyl radical is of not more than four carbon atoms.

7. The composition of claim 2 wherein said alkylpiperazine has the formula represented by the generic formula below:

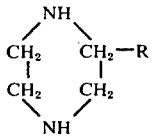

where R is a saturated aliphatic alkyl radical of from 1 to 18 carbon atoms.

8. A method for reducing the corrosiveness of oil well fluids toward ferrous metals coming into contact with said fluids which comprises mixing into said fluids a corrosion inhibiting amount of the corrosion inhibitor of claim 1, wherein the amount of said composition in said well fluid is at least about 10 ppm.

9. A method for reducing the corrosiveness of oil well fluids towards ferrous metals coming into contact with said fluids which comprises mixing into said fluids a corrosion inhibiting amount of the corrosion inhibitor of claim 2, wherein the amount of said composition in said well fluid is at least about 10 ppm.

10. A method for reducing the corrosiveness of oil-well fluids towards ferrous metals coming into contact with such fluids which comprises mixing into said fluids a corrosion inhibiting amount of the corrosion inhibitor of claim 4.

11. A method for reducing the corrosiveness of oil well fluids towards ferrous metals coming into contact with said fluids which comprises mixing into said fluids a corrosion inhibiting amount of the composition according to claim 5, wherein the amount of said composition in said well fluid is at least about 10 ppm.

12. A method for reducing the corrosiveness of oil-well fluids towards ferrous metals coming into contact with such fluids which comprises mixing into said fluids a corrosion inhibiting amount of the corrosion inhibitor of claim 6.

13. A method for reducing the corrosiveness of oil-well fluids towards ferrous metals coming into contact with such fluids which comprises mixing into said fluids a corrosion inhibiting amount of the corrosion inhibitor of claim 7.

* * * * *